US007437880B2

(12) United States Patent
Bansch et al.

(10) Patent No.: US 7,437,880 B2
(45) Date of Patent: Oct. 21, 2008

(54) PUMP BYPASS CONTROL APPARATUS AND APPARATUS AND METHOD FOR MAINTAINING A PREDETERMINED FLOW-THROUGH RATE OF A FLUID THROUGH A PUMP

(75) Inventors: Daniel Rowe Bansch, College Station, TX (US); Virgil Jordan, College Station, TX (US)

(73) Assignee: Refrigeration Valves and Systems Corp., Bryan, TX (US)

( * ) Notice: Subject to any disclaimer, the term of this patent is extended or adjusted under 35 U.S.C. 154(b) by 662 days.

(21) Appl. No.: 11/062,847

(22) Filed: Feb. 23, 2005

(65) Prior Publication Data

US 2006/0185374 A1 Aug. 24, 2006

(51) Int. Cl.
*F25B 41/00* (2006.01)
*F25B 49/00* (2006.01)
*F04B 49/00* (2006.01)

(52) U.S. Cl. ..... 62/196.3; 62/196.1; 417/43

(58) Field of Classification Search ..... 62/196.3, 62/196.1, 205; 417/43
See application file for complete search history.

(56) References Cited

U.S. PATENT DOCUMENTS 3,081,606 A 3/1963 Brose et al.
4,177,649 A * 12/1979 Venema ..... 62/209
4,599,873 A 7/1986 Hyde
5,435,148 A 7/1995 Sandofsky et al.
5,626,025 A 5/1997 Hyde
5,664,425 A 9/1997 Hyde
5,749,237 A 5/1998 Sandofsky et al.
6,076,367 A 6/2000 Sandofsky et al.
6,427,464 B1 * 8/2002 Beaverson et al. ..... 62/196.3

FOREIGN PATENT DOCUMENTS

JP 10238880 A * 9/1998

OTHER PUBLICATIONS

DD 93008 B Dec. 1974.*

* cited by examiner

*Primary Examiner*—Chen-Wen Jiang
(74) *Attorney, Agent, or Firm*—Rader, Fishman & Grauer

(57) ABSTRACT

A bypass control apparatus is used with a pump pumping a fluid therethrough. A bypass flow line circulates fluid about the pump. A bypass valve is interposed in the bypass flow line and moves between an opened state to permit the fluid to circulate through the bypass flow line back to the pump and a closed state to prevent the fluid from circulating through the bypass flow line. A sensor determines an existing flow-through rate of the fluid flowing through the pump. The controller communicates with the sensor and the bypass valve and moves the bypass valve to the closed state when determined that the existing flow-through rate of the fluid through the pump is at least a predetermined flow-through rate and moves the bypass valve to the opened state when determined that the existing flow-through rate of the fluid through the pump is less than the predetermined flow-through rate.

18 Claims, 8 Drawing Sheets

PUMP BYPASS CONTROL APPARATUS AND APPARATUS AND METHOD FOR MAINTAINING A PREDETERMINED FLOW-THROUGH RATE OF A FLUID THROUGH A PUMP

FIELD OF THE INVENTION

The present invention relates to apparatuses and a method for controlling flow of a fluid through a pump bypass. More particularly, the present invention is directed to apparatuses and a method that control the flow of a fluid through a bypass of a pump that requires a minimum flow-though rate of the fluid to remain in a stable operational state.

BACKGROUND OF THE INVENTION

In the field of refrigeration systems, for example, centrifugal pumps are typically used. These centrifugal pumps require continuous flow of liquid refrigerant through the pump via a bypass flow line to maintain stable operation of the centrifugal pump regardless of the refrigerant load requirements of the refrigeration plant. Even though the refrigerant load requirements of the refrigeration plant can vary from 0% to 100%, a minimum flow-through rate of the refrigerant continuously occurs through the centrifugal pump. The minimum flow-through is typically set for the pump by using either a fixed orifice, a manually adjustable valve disposed in the bypass flow line or appropriate sizing of the inner diameter of the bypass flow line.

As shown in FIGS. 1A-1C, a conventional refrigeration system 2 in a simplified form includes a refrigeration plant 4, a primary flow line 6, a pump 8 and a bypass flow line 10. The refrigeration plant 4 and the pump 8 are in fluid communication with one another via the primary flow line 6. A refrigerant 12, the flow of which being represented by arrows, flows clockwise, by way of example only, from the refrigeration plant 4 to the pump 8 via an upstream primary flow line section 6*a* and is pumped from the pump 8 to the refrigeration plant 4 via a downstream primary flow line section 6*b*. A primary flow line valve 14 is interposed in the downstream primary flow line section 6*b* and is positioned downstream of the bypass flow line 10. The bypass flow line 10 is in fluid communication with the primary flow line 6 with one end connected to the downstream primary flow line section 6*b* and an opposite end connected to the upstream primary flow line section 6*a*. The bypass flow line 10 enables circulation of at least a portion of the refrigerant 12 from a discharge (downstream) side of the pump 8 to a suction (upstream) side of the pump 8.

As illustrated in FIG. 1A, the primary flow line valve 14 is in a closed state and, as a result, there is no flow of the refrigerant 12 to the refrigeration plant 4 because there is no refrigerant required by the refrigeration plant 4. However, the pump 8 continues to operate in an idle mode in order to circulate the refrigerant 12 through the pump 8 to maintain its required minimum flow-through rate.

Thus, for the refrigeration system in FIG. 1A, the total flow TFR of the refrigerant 12 of the refrigeration system 2 is calculated as the sum of the minimum flow-through MFR of the pump 8 plus the flow rate requirements FRR of the refrigeration plant 4 stated as follows:

$$TFR=MFR+FRR \quad (1).$$

By way of example only, assume that the minimum flow-through MFR of the pump 8 is 15 gallons per minute. Therefore, the total flow TFR, when the refrigerant load requirements of the refrigeration plant 4 is zero, is equal to 15 gallons per minute which is calculated as follows:

$$TFR=15+0 \quad (2).$$

As illustrated in FIG. 1B, the primary flow line valve 14 is in an opened state. More specifically, the primary flow line valve 14 is in a partially opened condition because the refrigerant flow requirements of the refrigeration plant is less than 100%, say, for example, 60% or 60 gallons per minute. In this case, the total flow rate TFR of the refrigerant 12 of the refrigeration system 2 is 75 gallons per minute which is calculated as follows:

$$TFR=15+60 \quad (3).$$

As illustrated in FIG. 1C, the primary flow line valve 14 is also in the opened state. More specifically, the primary flow line valve 14 is in a wide opened condition, i.e. fully opened condition, because the refrigerant flow requirements of the refrigeration plant is now 100% or 100 gallons per minute. In this case, the total flow TFR of the refrigerant 12 of the refrigeration system 2 is 115 gallons per minute which is calculated as follows:

$$TFR=15+100 \quad (4).$$

The refrigeration system 2 of FIGS. 1A-1C requires that the pump 8 has a pumping capacity of at least 115 gallons of refrigerant 12 per minute. Furthermore, the inner diameter of the primary flow line 6 at the suction side of the pump 8 and at the discharge side of the pump 8, particularly between the bypass flow line 10, must be sufficiently large to safely and effectively pass 115 gallons of refrigerant 12 per minute therethrough. Also, pump manufacturers typically build pumps in incremental flow capacities such as 100 gallons per minute, 125 gallons per minute and so on. In this case, the refrigeration system 2 would require a pump having a flow capacity of 125 gallons per minute. In turn, the primary flow line 6 at the suction side and discharge side of the pump 8 of the refrigeration system 2 should be designed to handle the flow capacity of 125 gallons per minute even though the flow capacity of only 115 gallons per minute for the refrigeration system 2 is required.

It would be beneficial to provide a bypass control apparatus that would enable a manufacturer, for example only, of the above refrigeration system to use a pump with a flow capacity of 100 gallons per minute rather than one having a flow capacity 125 gallons per minute or even 115 gallons per minute (even if one was available) without sacrificing the refrigeration capacity of the refrigeration system. Having such a bypass control apparatus would reduce the cost of manufacturing the refrigeration system, particularly with regard to a smaller capacity pump and a smaller diameter primary flow line at the suction side and discharge side of the pipe. Such a smaller capacity pump would result in less energy required to operate the refrigeration system without sacrificing refrigeration capacity. The present invention provides these advantages and benefits.

OBJECTS AND SUMMARY OF THE INVENTION

It is an object of the invention to provide a bypass control apparatus, an apparatus for maintaining a predetermined flow-through rate of a fluid through a pump and a method that selectively permit or prevent a bypass fluid to circulate from a discharge side of a pump to a suction of a pump via a bypass flow line.

It is another object of the invention to provide a bypass control apparatus, an apparatus for maintaining a predetermined flow-through rate of a fluid through a pump and a method that reduce manufacturing cost of systems having a pump with a required minimum flow-though rate in order to maintain stable pumping operations.

It is yet another object of the invention to provide a bypass control apparatus, an apparatus for maintaining a predetermined flow-through rate of a fluid through a pump and a method that reduce operating cost of systems having a pump with required minimum flow-though rate to maintain stable pumping operations.

A bypass control apparatus of the present invention is adapted for use with a pump pumping a fluid therethrough and includes a bypass flow line, a bypass valve, a sensor and a controller. The bypass flow line is operative for circulating at least a portion of the fluid from a discharge side of the pump to a suction side of the pump. The bypass valve is interposed in the bypass flow line and is operative to move to and between an opened state thereby permitting the at least portion of the fluid flowing through the pump to continuously circulate through the bypass flow line back to the pump and a closed state thereby preventing the at least portion of the fluid from circulating through the bypass flow line. The sensor determines an existing flow-through rate of the fluid being pumped through the pump.

The controller is in communication with the sensor and the bypass valve and is operative to move the bypass valve to the closed state when the controller determines that the existing flow-through rate of the fluid flowing through the pump is at least a predetermined flow-through rate and to move the bypass valve to the opened state when the controller determines that the existing flow-through rate of the fluid flowing through the pump is less than the predetermined flow-through rate.

A method of the present invention maintains a predetermined flow-through rate of a fluid flowing through a pump connected to and in fluid communication with a bypass flow line with a bypass valve interposed in the bypass flow line, comprising the steps of determining an existing flow-through rate of the fluid flowing through the pump; determining whether the existing flow-through rate of the fluid flowing through the pump is equal to the predetermined flow-through rate; and if the existing flow-through rate of the fluid flowing through the pump is determined to be less than the predetermined flow-through rate, opening the bypass valve to permit at least a portion of the fluid flowing through the pump to circulate from a discharge side of the pump to a suction side of the pump through the bypass flow line and if the existing flow-through rate of the fluid flowing through the pump is determined to be greater than or equal to the predetermined flow-through rate, closing the bypass valve.

An apparatus of the present invention maintains a predetermined flow-through rate of a fluid flowing through a pump connected to and in fluid communication with a bypass flow line with by pass valve interposed in the bypass flow line and includes a device for determining an existing flow-through rate of the fluid flowing through the pump, a device for determining whether the existing flow-through rate of the fluid through the pump is equal to the predetermined flow-through rate and a device for opening and closing the bypass valve as a function of whether the existing flow-through rate is equal to the predetermined flow-through rate. If the existing flow-through rate of the fluid flowing through the pump is determined to be less than the predetermined flow-through rate, the device for opening and closing the bypass valve opens the bypass valve to permit at least a portion of the fluid flowing through the pump to circulate from a discharge side of the pump to a suction side of the pump through the bypass flow line. If the existing flow-through rate of the fluid flowing through the pump is determined to be greater than or equal to the predetermined flow-through rate, the device for opening and closing the bypass valve closes the bypass valve.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1A:
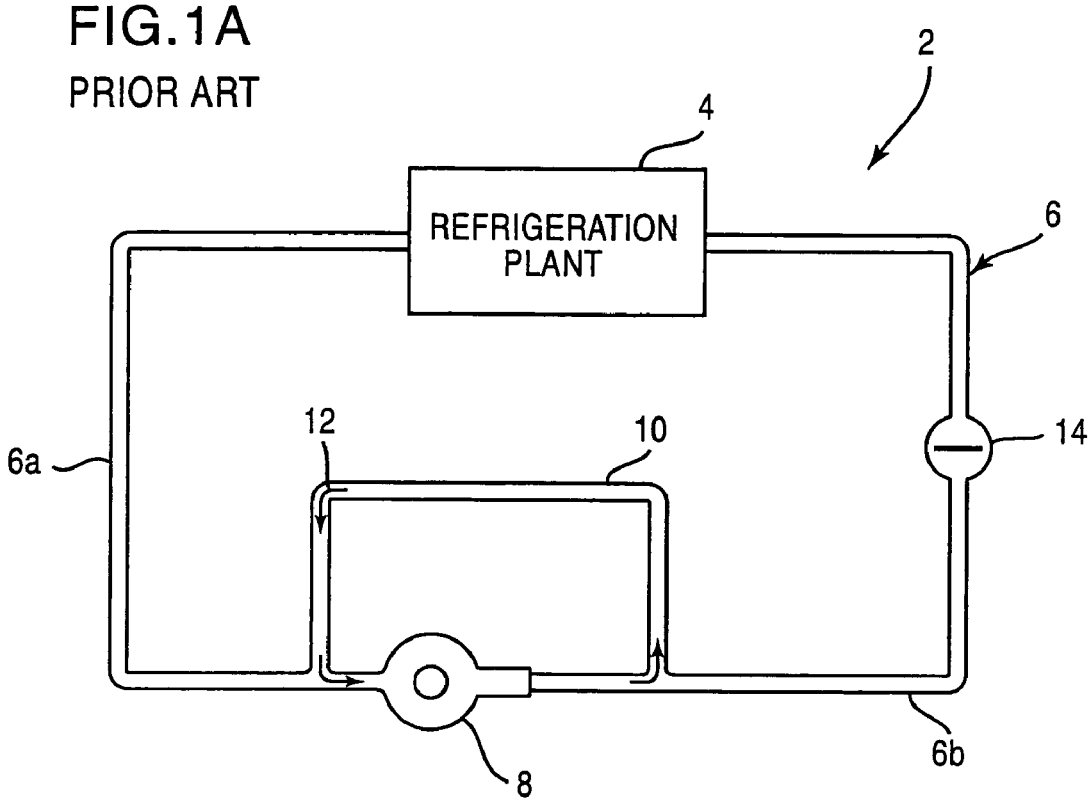
FIG.1A PRIOR ART
FIG. 1A is a diagrammatical view of a conventional refrigeration system with a primary flow line valve in a closed state.
Figure 1B:
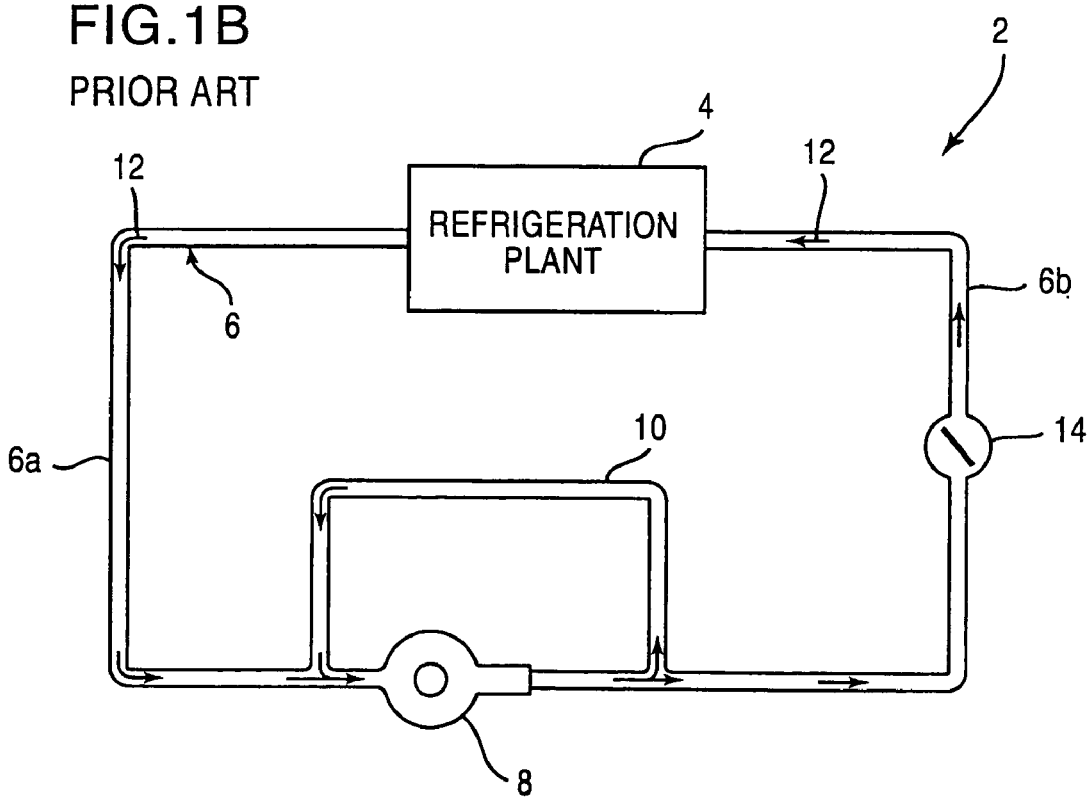
FIG.1B PRIOR ART
FIG. 1B is a diagrammatical view of the conventional refrigeration system of FIG. 1A with the primary flow line valve in an opened state, particularly in a partially opened condition.
Figure 1C:
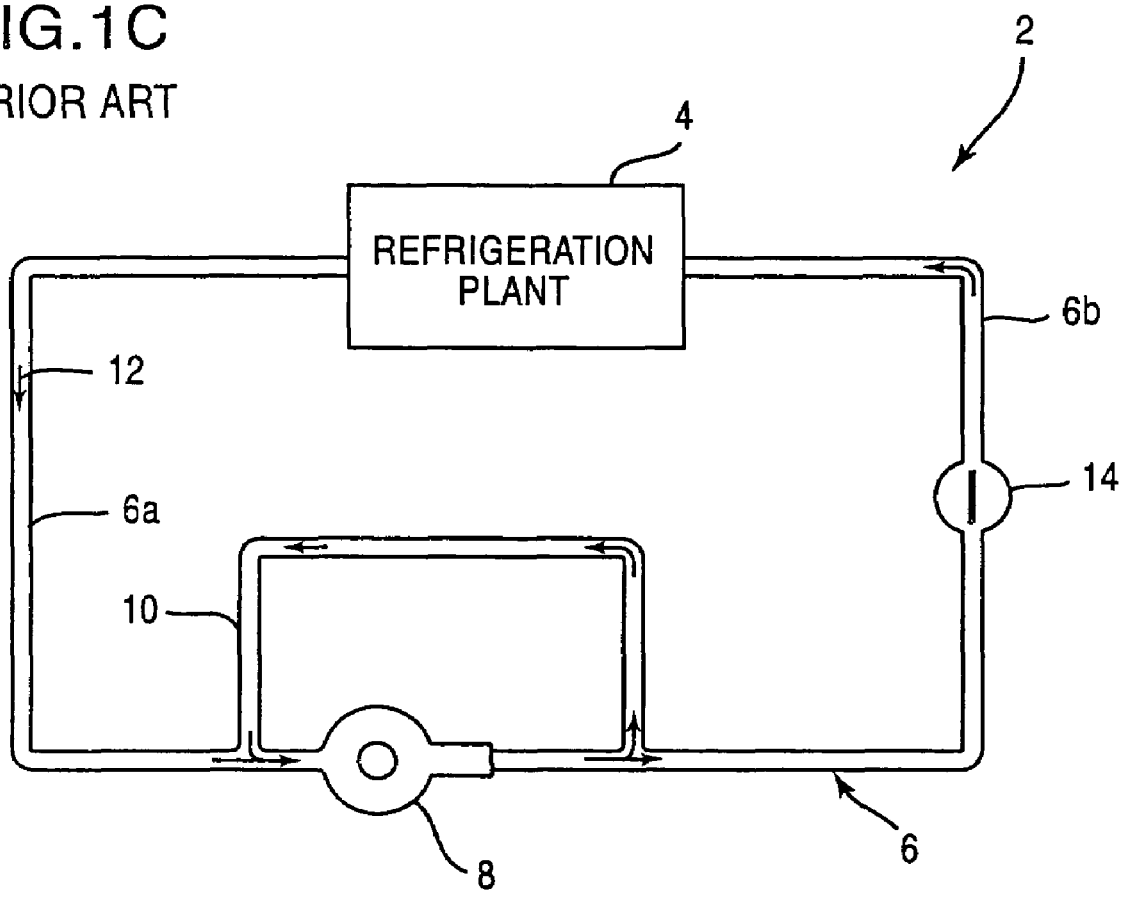
FIG.1C PRIOR ART
FIG. 1C is a diagrammatical view of the conventional refrigeration system of FIGS. 1A and 1B with the primary flow line valve in the opened state, particularly in a wide opened state.

Hereinafter, exemplary embodiments of the present invention will be described with reference to the attached drawings. The structural components common to those of the prior art and the structural components common to respective embodiments of the present invention will be represented by the same symbols and repeated description thereof will be omitted. Further, a skilled artisan would appreciate that the drawing figures are representative diagrammatical views to illustrate the components necessary to describe the present invention and that other components non-essential to the inventive concept have not been illustrated for ease of understanding the present invention.

Figure 2A:
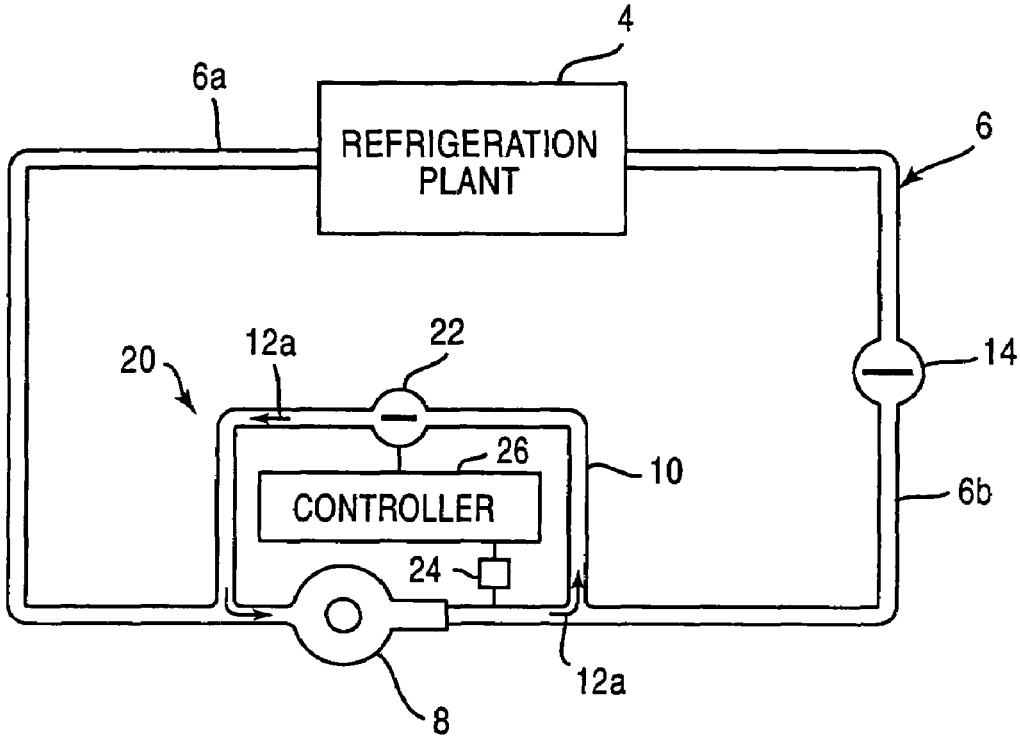
FIG. 2A is a diagrammatical view of a first embodiment of a bypass control apparatus incorporated into a refrigeration system with the primary flow line valve in a closed state and a bypass valve in the wide opened condition.
Figure 2B:
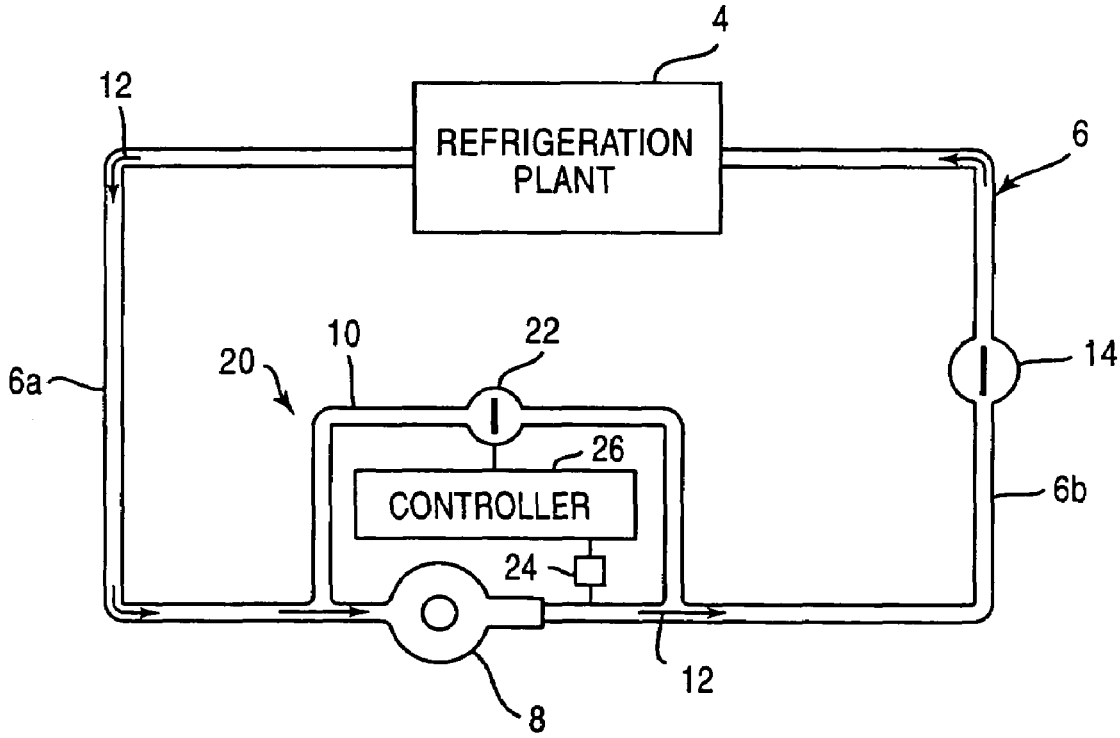
FIG. 2B is a diagrammatical view of the first embodiment of the bypass control apparatus with the primary flow line valve in a wide opened condition and the bypass valve in the closed state.

A first exemplary embodiment of a bypass control apparatus 20 of the present invention is hereinafter described with reference to FIGS. 2A and 2B. As best shown in FIGS. 2A and 2B, the bypass control apparatus 20 of the present invention is used with the refrigeration plant 4 and is in fluid communication with the primary flow line 6. A pump 8 circulates the refrigerant 12 about the primary flow line 6 and through the refrigeration plant 4 when the refrigerant 12 is required by the refrigeration plant 4. The bypass control apparatus 20 of the present invention includes the bypass flow line 10, a bypass valve 22, a sensor 24 and a controller 26.

The bypass flow line 10 is in fluid communication with the primary flow line 6 and is operative for circulating at least a portion 12*a* of the refrigerant 12 from a discharge (downstream) side of the pump 8 to a suction (upstream) side of the pump 8. The bypass valve 22 is interposed in the bypass flow line 10 and is operative to move to and between an opened state (FIG. 2A) and a closed state (FIG. 2B). As shown in the opened state in FIG. 2A, the bypass valve 22 permits the at least portion 12*a* of the refrigerant 12 being pumped through the pump 8 to continuously circulate through the bypass flow line 10 and back to the pump 8. As shown in the closed state in FIG. 2B, the bypass valve 22 prevents the at least portion 12*a* (see FIG. 2A) of the refrigerant 12 from circulating through the bypass flow line 10.

The sensor 24 determines an existing flow-through rate of the refrigerant 12 being pumped through the pump 8. The controller 26 is in communication with the sensor 24 and the bypass valve 22 and is operative to move the bypass valve to and between the closed state and the opened state. When the bypass valve 22 is in the closed state, the controller 26 determines that the existing flow-through rate of the refrigerant 12 through the pump 8 is at least a predetermined flow-through rate. The controller 26 moves the bypass valve 22 to the opened state when the controller determines that the existing flow-through rate of the refrigerant 12 through the pump 8 is less than the predetermined flow-through rate.

For the first exemplary embodiment of the bypass control apparatus 20 of the present invention, the sensor 24 is a fluid flow meter. However, one of ordinary skill in the art would appreciate that the sensor 24 can be any type of fluid flow measuring device capable of directly or indirectly measuring the flow-through rate of the refrigerant 12 through the pump 8. As a result, the invention is not limited as to what or how the flow of the refrigerant is measured. Further, the sensor 24 represented as a fluid flow meter is disposed on the discharge side of and adjacent to the pump 8 and on the primary flow line 6 at a position before the at least portion 12*a* of the refrigerant flows into the bypass flow line 10 as shown in FIG. 2A.

Although not by way of limitation, the controller 26 is a microprocessor. The microprocessor is operative to receive input signals from the sensor 24, process the input signals and transmit the processed input signals as output signals to the bypass valve 22. In turn, the bypass valve 22 is moved to and between the opened state and the closed state based upon the output signals.

Furthermore, a skilled artisan would appreciate that the controller 26 can be a switch that simply switches to and between an ON state and an OFF state. Depending upon the signal received from the sensor 24, the switch moves to and between the ON state and the OFF state.

For the first exemplary embodiment of the bypass control apparatus 20 of the present invention, when the bypass valve 22 is in the opened state, the primary flow line valve 14 is in the closed state as illustrated in FIG. 2A. Correspondingly, for the first exemplary embodiment of the bypass control apparatus 20 of the present invention, when the bypass valve 22 is in the closed state, the primary flow line valve 14 is in the opened state as illustrated in FIG. 2B. Also, for the first exemplary embodiment of the bypass control apparatus 20 of the present invention, the bypass valve 22, when in the opened state, is in a wide opened condition, i.e., a fully opened condition. Further, when the bypass valve 22 is in the opened state, the bypass valve 22 remains in the opened state at least until the existing flow-through at least equals the predetermined flow-through rate.

By way of example only and not by way of limitation, the first exemplary embodiment of the bypass control apparatus 20 of the present invention is installed in the refrigeration system 2 described above. In this example, the predetermined flow-through rate of the refrigerant 12 through the pump 8 is selected as 30 gallons per minute. As illustrated in FIG. 2A, the primary flow line valve 14 is in a closed state and, as a result, there is no refrigerant 12 flow to the refrigeration plant 4 because there is no refrigerant load required by the refrigeration plant 4. However, the pump 8 continues to operate above its idle mode in order to circulate the refrigerant 12 through the pump 8 and the bypass valve 22 in its opened state, more particularly, in a wide opened condition, at a predetermined flow-through rate of 30 gallons per minute, which exceeds its required minimum flow-through rate of 15 gallons per minute by an additional 15 gallons per minute. Thus, for the refrigeration system in FIG. 2A, the total flow rate TFR of the refrigerant 12 of the refrigeration system 2 circulates only within the bypass flow line 10 at 30 gallons per minute.

As illustrated in FIG. 2B, the primary flow line valve 14 is in an opened state. More specifically, the primary flow line valve 14 is in a wide opened condition because the refrigerant flow requirements of the refrigeration plant are 100% or 100 gallons per minute. In this case, the controller 26 moves the bypass valve 22 to the closed state when the controller 22 determines that the existing flow-through rate, i.e., 100 gallons per minute of the refrigerant 12 through the pump 8 is at least the predetermined flow-through rate of 30 gallons per minute. Thus, for the refrigeration system 2 in FIG. 2B, the total flow rate TFR of the refrigerant 12 that circulates through the refrigeration plant 4, the primary flow line 6 and the pump 8 is 100 gallons per minute. In summary, as a result of the first exemplary embodiment of the bypass control apparatus 20 of the present invention, there is no need to operate the pump 8 at a capacity greater than 100 gallons per minute. Furthermore, the bypass valve 22 operates in either a closed state or a wide opened condition, i.e. either in a fully closed state or a fully opened state. Also, one of ordinary skill in the art would appreciate that the controller 26 might be the switch as mentioned above.

Figure 3A:
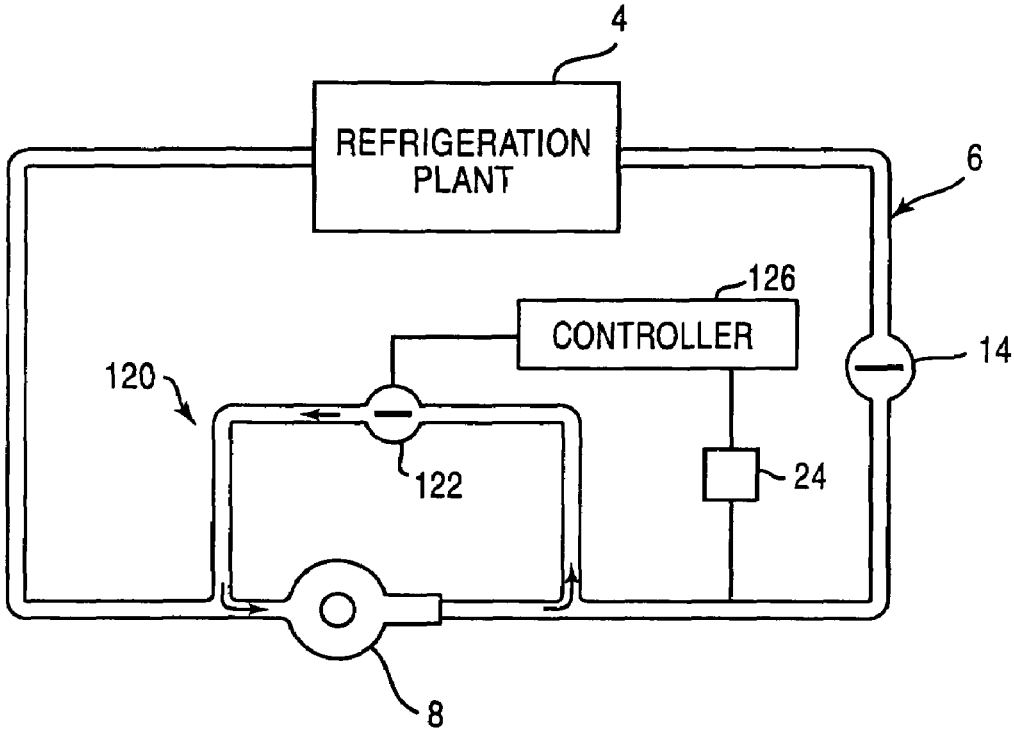
FIG. 3A is a diagrammatical view of a second embodiment of the bypass control apparatus incorporated into a refrigeration system with the primary flow line valve in the closed state and a bypass valve in the wide opened condition.
Figure 3B:
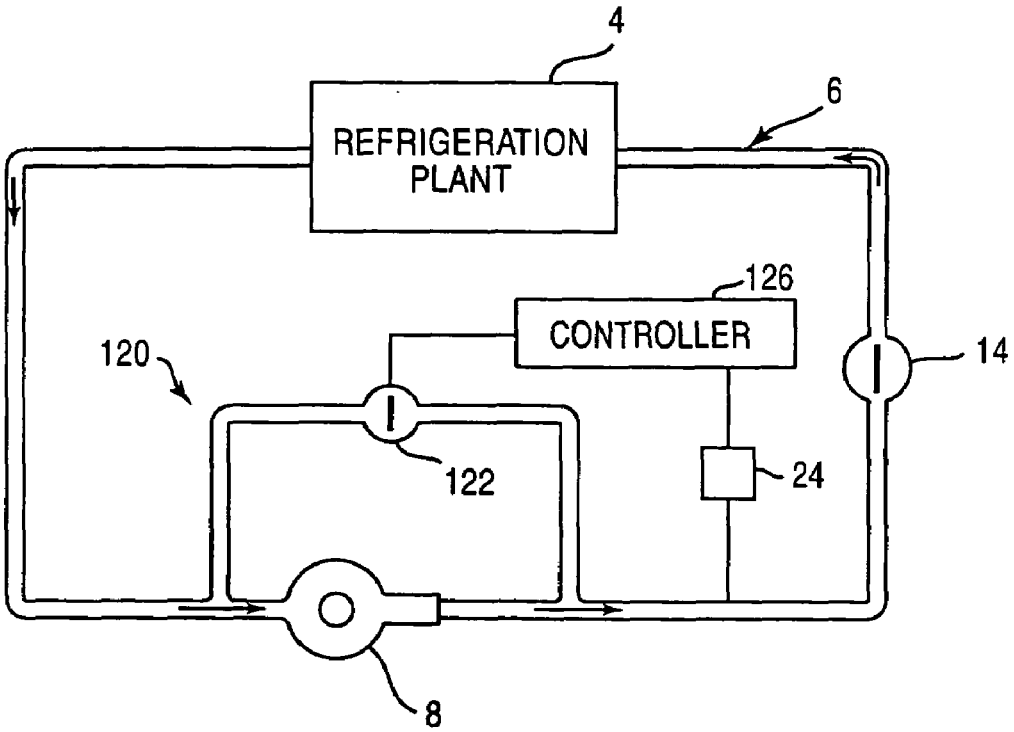
FIG. 3B is a diagrammatical view of the second embodiment of the bypass control apparatus with the primary flow line valve in the wide opened condition and the bypass valve in the closed state.
Figure 3C:
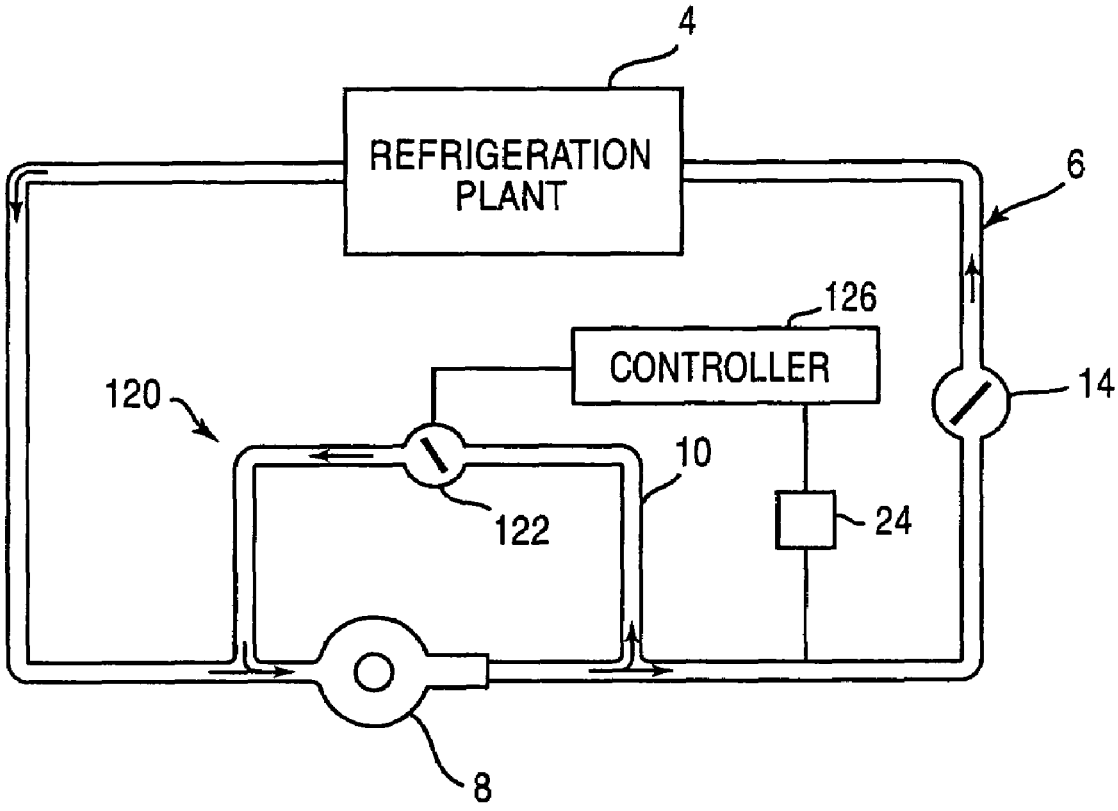
FIG. 3C is a diagrammatical view of a second embodiment of the bypass control apparatus with the primary flow line valve in a partially opened condition and the bypass valve in a partially opened condition.

A second exemplary embodiment of a bypass control apparatus 120 of the present invention is illustrated in FIGS. 3A-3C. The components and functionality of the second exemplary embodiment of the bypass control apparatus 120 of the present invention are similar to the first exemplary embodiment. Specifically, the bypass control apparatus 120 of the present invention includes a bypass valve 122 and a controller 126 that differ from the first exemplary embodiment. In the first exemplary embodiment, the bypass valve 22 moves only to and between a closed state and a wide opened condition while the bypass valve 122 of the second embodiment is a variable valve that can move to a partially opened condition in the opened state. More particularly, the partially opened condition is defined as being between the wide opened condition and the closed state. Also, not by way of limitation, the sensor 24 in the form of a fluid flow meter is positioned after the at least portion 12*a* of the refrigerant 12 flows into the bypass flow line 10. In other words, one of ordinary skill in the art would appreciate that the position of the sensor 24 is optional.

Because the bypass valve 122 of the second embodiment of the present invention is a variable valve, the functionality of the second embodiment of the bypass control apparatus 122 is somewhat different than the functionality of the first embodiment. As noted above, the bypass valve 22 of the first embodiment moves between either the closed state or the fully opened condition i.e., the bypass valve is either completely closed or completely opened. Thus, one of ordinary skill in the art would appreciate that the predetermined flow-through rate of the refrigerant must exceed the minimum flow-through rate of the pump for the first exemplary embodiment to operate properly. Preferably, the predetermined flow-through rate of the refrigerant must be at least twice the minimum flow-through rate of the pump.

The bypass valve 122 of the second embodiment of the present invention, being variable, enables the predetermined flow-through rate of the refrigerant to be equal to or approximately equal to the minimum flow-through rate of the pump. Thus, the predetermined flow-though rate of the refrigerant might be equal to or greater than the minimum flow-through rate of the pump. Also, a skilled artisan would appreciate that the predetermined flow-through rate of the refrigerant might be less than the minimum flow-through rate of the pump. For example, the manufacturer of the pump determines the minimum flow-through rate to be 15 gallons per minute. A user of this pump might test it and determine from the user's test results an acceptable flow-through rate of 14 gallons per minute in order to maintain stable pumping operations.

By way of example only and not by way of limitation, the second exemplary embodiment of the bypass control apparatus 120 of the present invention is installed in the refrigeration system 2 described above. In this example, the predetermined flow-through rate of the refrigerant 12 through the pump 8 is selected as 15 gallons per minute, i.e. the minimum flow-through rate of the pump. As illustrated in FIG. 3A, the primary flow line valve 14 is in a closed state and, as a result, there is no flow of the refrigerant 12 to the refrigeration plant 4 because there is no refrigerant load required by the refrigeration plant 4. However, the pump 8 continues to operate in its idle mode in order to circulate the refrigerant 12 through the pump 8 and the bypass valve 22 in its opened state, more particularly, in a wide opened condition, at the predetermined flow-through rate of 15 gallons per minute, which equals the required minimum flow-through rate of the pump of 15 gallons per minute. Thus, for the refrigeration system in FIG. 3A, the total flow rate TFR of the refrigerant 12 of the refrigeration system 2 circulates only through the bypass flow line 10 at 15 gallons per minute.

As illustrated in FIG. 3B, the primary flow line valve 14 is in an opened state. More specifically, the primary flow line valve 14 is in a wide opened condition because the refrigerant flow requirements of the refrigeration plant are 100% or 100 gallons per minute. In this case, the controller 126 moves the bypass valve 22 to the closed state when the controller 22 determines that the existing flow-through rate, i.e., 100 gallons per minute of the refrigerant 12 through the pump 8 is at least the predetermined flow-through rate of 15 gallons per minute. Thus, for the refrigeration system 2 in FIG. 2B, the total flow rate TFR of the refrigerant 12 circulates through the refrigeration plant 4, the primary flow line 6 and the pump 8 at 100 gallons per minute. In summary, as a result of the second exemplary embodiment of the bypass control apparatus 120 of the present invention, just like the first embodiment, there is no need to operate the pump 8 at a capacity greater than 100 gallons per minute and the bypass valve 122 operates in the closed state as shown in FIG. 3B or a wide opened condition as shown in FIG. 3A.

As illustrated in FIG. 3C, the primary flow line valve 14 is in a partially opened state because the refrigerant flow requirements of the refrigeration plant are, for example, 10% or 10 gallons per minute. In this case, the controller 126 moves the bypass valve 122 to a partially opened condition. Since the required minimum flow-through rate of the pump is 15 gallons per minute and the refrigerant flow requirements are 10 gallons per minute, the controller permits only 5 gallons per minute to circulate from the discharge side of the pump to the suction side of the pump. Thus, the predetermined flow-through rate is equal to the minimum flow-through rate of the pump. A skilled artisan would appreciate that the operating cost, particularly for energizing the pump, is even less compared to the first embodiment as a result of the variable bypass valve 122 and the controller 126 operative to control the opening and closing of the same of the second embodiment of the invention.

Figure 4:
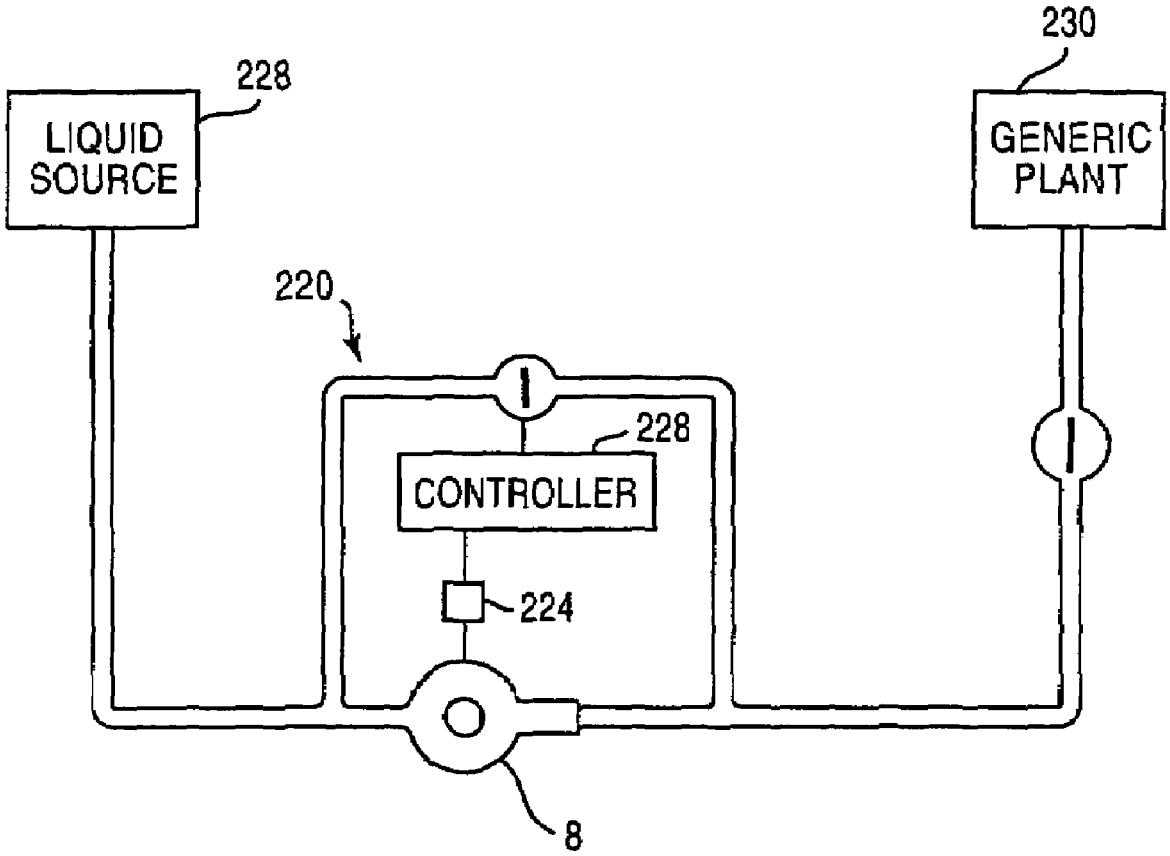
FIG. 4 is a diagrammatical view of a third embodiment of the bypass control apparatus with the sensor in electrical communication with the pump used in a generic plant.

A third exemplary embodiment of the bypass control apparatus 220 of the invention is illustrated in FIG. 4. The components and functionality of the third exemplary embodiment is similar to the first and second exemplary embodiments. Note that the sensor 224 is directly connected to the pump 8. The sensor 224 is in the form of an ammeter electrically connected to the pump and a controller 228 operably connected thereto. One of ordinary skill in the art would appreciate that electrical readings from the ammeter can be converted into flow-through readings for use by the present invention.

Also, it is noted that the bypass control apparatus of the present invention can be used for non-circulatory systems other than circulatory refrigeration systems. By way of example, rather than a liquid refrigerant, any liquid or fluid can be used and, rather than a refrigeration plant, any generic plant can be used. For instance, liquid source 228 might be a hydraulic fluid, gasoline or diesel fuel while the generic plant 230 might be a hydraulic cylinder, a spark ignition engine or a gas turbine engine.

Figure 5:
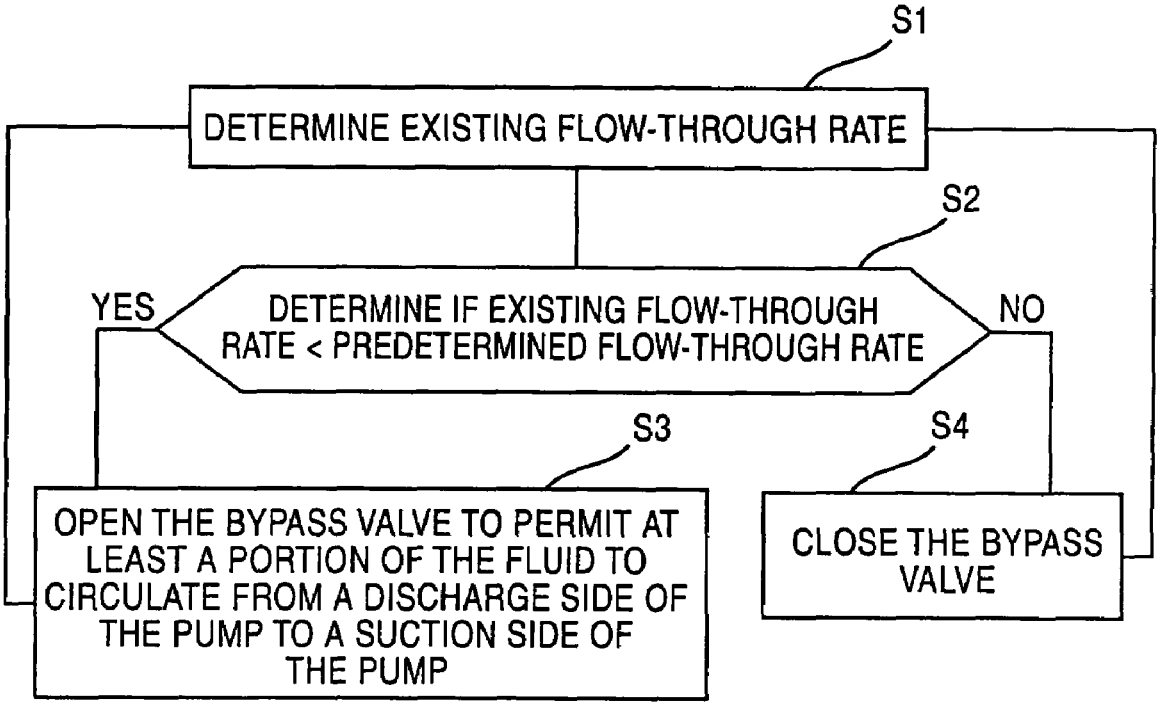
FIG. 5 is a flow chart of a fourth embodiment of the present invention as a method for maintaining the predetermined flow-through rate of the fluid flowing through the pump.

FIG. 5 is a flow chart of a method of a fourth exemplary embodiment of the present invention for maintaining a predetermined flow-through rate of the fluid flowing through the pump connected to and in fluid communication with the bypass flow line with the bypass valve interposed in the bypass flow line based upon the above-described embodiments of the present invention. Step S1 is determining an existing flow-through rate of the fluid flowing through the pump. Step S2 is determining whether the existing flow-through rate of the fluid flowing through the pump is equal to the predetermined flow-through rate. Then, if the existing flow-through rate of the fluid flowing through the pump is determined to be less than the predetermined flow-through rate, step S3 is initiated. Step S3 is opening the bypass valve to permit at least a portion of the fluid flowing through the pump to circulate from a discharge side of the pump to a suction side of the pump through the bypass flow line. However, if the existing flow-through rate of the fluid flowing through the pump is determined to be greater than or equal to the predetermined flow-through rate, step S4 is initiated. Step S4 closes the bypass valve. After step S3 or S4, the method of the present invention returns to step S1. As discussed above, step of opening the bypass valve opens the bypass valve from a closed state to an opened state and the opened state can be either a wide opened condition or a partially opened condition.

Figure 6:
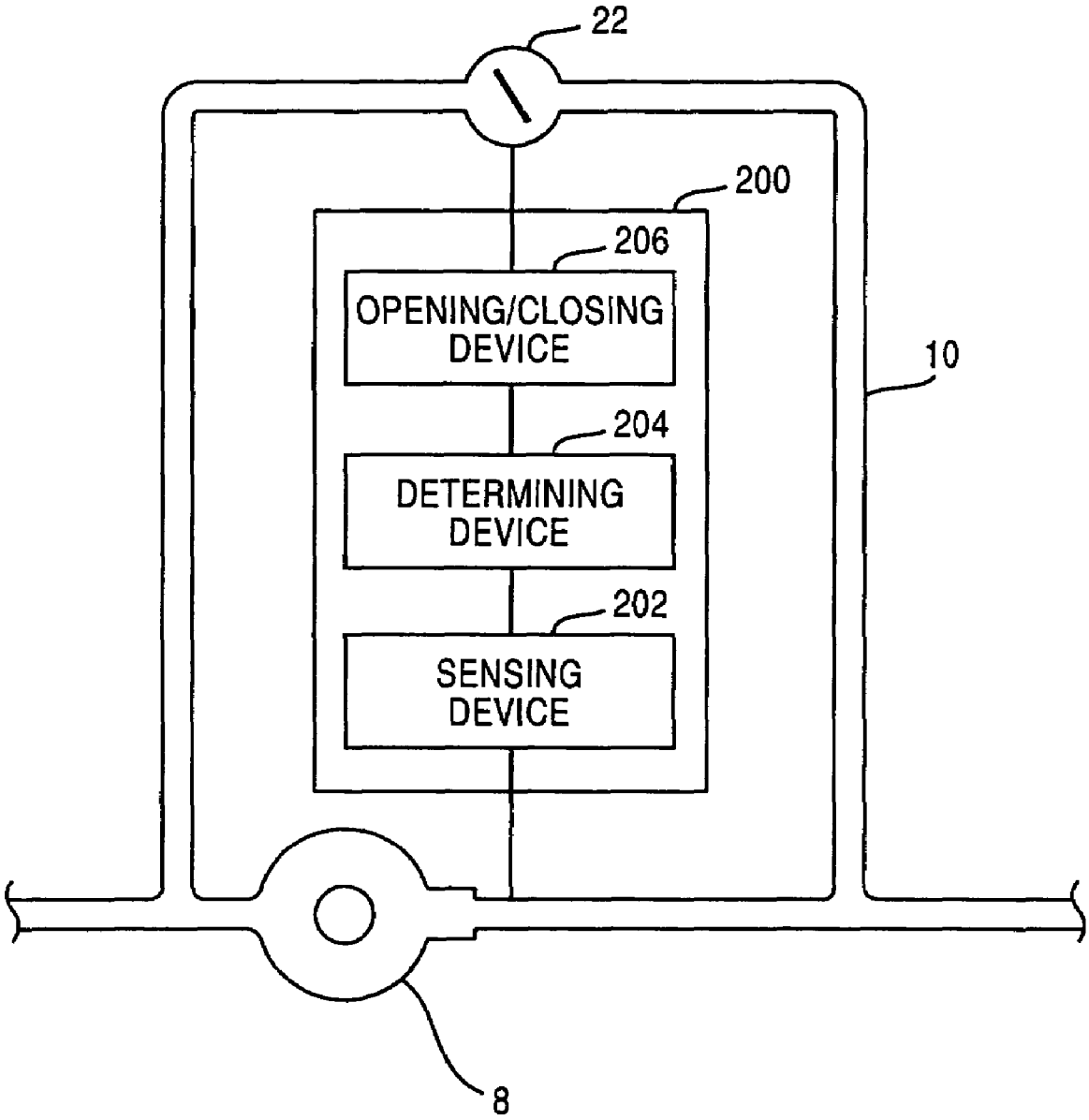
FIG. 6 is a diagrammatical view of an apparatus of a fifth embodiment of the present invention for maintaining the predetermined flow-through rate of the fluid flowing through the pump implementing the method depicted in FIG. 5.

Based upon the method of the present invention, an apparatus 200 of a fifth exemplary embodiment of the present invention for maintaining the predetermined flow-through rate of the fluid flowing through the pump connected to and in fluid communication with the bypass flow line with by pass valve interposed in the bypass flow line is hereinafter described and illustrated in FIG. 6. The apparatus 200 of the present invention includes a sensing device 202 for determining an existing flow-through rate of the fluid flowing through the pump such as the sensor described above and a determining device 204 for determining whether the existing flow-through rate of the fluid flowing through the pump is equal to the predetermined flow-through rate for opening and closing the bypass valve as a function of whether the existing flow-through rate is equal to the predetermined flow-through rate such as the controller described above and an opening/closing device 206 for opening and closing the bypass valve.

If the existing flow-through rate of the fluid flowing through the pump is determined to be less than the predetermined flow-through rate, the opening/closing device 206 opens the bypass valve to permit at least a portion of the fluid flowing through the pump to circulate from a discharge side of the pump to a suction side of the pump through the bypass flow line. If the existing flow-through rate of the fluid flowing through the pump is determined to be greater than or equal to the predetermined flow-through rate, the opening/closing device 206 closes the bypass valve. The opening/closing device 206 is operative to move the bypass valve to and between a closed state and an opened state. The opened state can be either a wide opened condition or a partially opened condition as discussed above.

The exemplary embodiments of the invention include a bypass control apparatus for a pump, an apparatuses for maintaining a predetermined flow-through rate of a fluid flowing through the pump and a method for maintaining a predetermined flow-through rate of a fluid flowing through the pump. All of the exemplary embodiments either permit or prevent a bypass fluid to circulate from a discharge side of a pump to a suction of a pump via a bypass flow line so as to reduce manufacturing cost of systems having a pump with a required minimum flow-though rate to maintain stable pumping operations and to reduce operating and manufacturing costs of systems having such a pump.

The present invention, may, however, be embodied in various different forms and should not be construed as limited to the exemplary embodiments set forth herein. Rather, these exemplary embodiments are provided so that this disclosure will be thorough and complete and will fully convey the scope of the present invention to those skilled in the art. Additionally, one of ordinary skill in the art would appreciate other advantages and benefits of the present invention that are not specifically discussed herein and that all advantages and benefits of the present invention are not necessary gained in each one of the claims.

What is claimed is:

1. A bypass control apparatus adapted for use with a pump pumping a liquid therethrough, comprising:

a bypass flow line operative for circulating at least a portion of the liquid flowing through the pump from a discharge side of the pump to a suction side of the pump;

a bypass valve interposed in the bypass flow line and operative to move to and between an opened state thereby permitting the at least portion of the liquid flowing through the pump to continuously circulate through the bypass flow line back to the pump and a closed state thereby preventing the at least portion of the liquid flowing through the pump from circulating through the bypass flow line;

a sensor for determining an existing flow-through rate of the liquid flowing through the pump; and a controller in communication with the sensor and the bypass valve and operative to move the bypass valve to the closed state when the controller determines that the existing flow-through rate of the liquid flowing through the pump is at least a predetermined flow-through rate and to move the bypass valve to the opened state when the controller determines that the existing flow-through rate of the liquid flowing through the pump is less than the predetermined flow-through rate.

2. A bypass control apparatus according to claim 1, wherein when the bypass valve is in the opened state, the bypass valve is either in a wide opened condition or in an partially opened condition defined as being between the wide opened condition and the closed state.

3. A bypass control apparatus according to claim 1, wherein the sensor includes one of a liquid flow meter and an ammeter electrically connected to the pump.

4. A bypass control apparatus according to claim 3, wherein the liquid flow meter is disposed at the discharge side of the pump.

5. A bypass control apparatus according to claim 4, wherein the liquid flow meter is disposed adjacent the pump.

6. A bypass control apparatus according to claim 1, wherein the controller is a microprocessor operative to receive input signals from the sensor, process the input signals into output signals and transmit the output signals to the bypass valve to move the bypass valve to and between the opened state and the closed state based upon the output signals.

7. A bypass control apparatus according to claim 1, wherein when the bypass valve is in the opened state, the bypass valve remains in the opened state at least until the existing flow-through at least equals the predetermined flow-through rate.

8. A bypass control apparatus adapted for use with a refrigeration plant in fluid communication with a primary flow line having a pump for circulating a liquid refrigerant about the primary flow line and through the refrigeration plant, the bypass control apparatus comprising:

a bypass flow line in fluid communication with the primary flow line and operative for circulating at least a portion of the liquid refrigerant from a discharge side of the pump to a suction side of the pump;

a bypass valve interposed in the bypass flow line and operative to move to and between an opened state thereby permitting the at least portion of the liquid refrigerant to continuously circulate through the bypass flow line back to the pump and a closed state thereby preventing the at least portion of the liquid refrigerant from circulating through the bypass flow line;

a sensor for determining an existing flow-through rate of the liquid refrigerant being pumped through the pump; and a controller in communication with the sensor and the bypass valve and operative to move the bypass valve to the closed state when the controller determines that the existing flow-through rate of the liquid refrigerant through the pump is at least a predetermined flow-through rate and to move the bypass valve to the opened state when the controller determines that the existing flow-through rate of the liquid refrigerant through the pump is less than the predetermined flow-through rate.

9. A bypass control apparatus according to claim 8, wherein when the bypass valve is in the opened state, the bypass valve is either in a wide opened condition or in an partially opened condition defined as being between the wide opened condition and the closed state.

10. A bypass control apparatus according to claim 8, wherein the sensor includes one of a liquid flow meter and an ammeter electrically connected to the pump.

11. A bypass control apparatus according to claim 10, wherein the liquid flow meter is disposed on the discharge side of the pump and on the primary flow line at a position either before the at least portion of the refrigerant flows into the bypass flow line or after the at least portion of the refrigerant flows into the bypass flow line.

12. A bypass control apparatus according to claim 8, wherein the controller is a microprocessor operative to receive input signals from the sensor, process the input signals into output signals and transmit the output signals to the bypass valve to move the bypass valve to and between the opened state and the closed state based upon the output signals.

13. A bypass control apparatus according to claim 8, wherein when the bypass valve is in the opened state, the bypass valve remains in the opened state at least until the existing flow-through at least equals the predetermined flow-through rate.

14. A method for maintaining a predetermined flow-through rate of a liquid flowing through a pump connected to and in liquid communication with a bypass flow line with a bypass valve interposed in the bypass flow line, comprising the steps of:

determining an existing flow-through rate of the liquid flowing through the pump;

determining whether the existing flow-through rate of the liquid flowing through the pump is equal to the predetermined flow-through rate; and if the existing flow-through rate of the liquid flowing through the pump is determined to be less than the predetermined flow-through rate, opening the bypass valve to permit at least a portion of the liquid flowing through the pump to circulate from a discharge side of the pump to a suction side of the pump through the bypass flow line; and if the existing flow-through rate of the liquid flowing through the pump is determined to be greater than or equal to the predetermined flow-through rate, closing the bypass valve.

15. A method according to claim 14, wherein, the step of opening the bypass valve opens the bypass valve from a closed state to an opened state, the opened state being one of a wide opened condition and a partially opened condition defined as being between the wide opened condition and the closed state.

16. An apparatus for maintaining a predetermined flow-through rate of a liquid flowing through a pump connected to and in fluid communication with a bypass flow line with a bypass valve interposed in the bypass flow line, comprising:

means for determining an existing flow-through rate of the liquid flowing through the pump;

means for determining whether the existing flow-through rate of the liquid flowing through the pump is equal to the predetermined flow-through rate; and means for opening and closing the bypass valve as a function of whether the existing flow-through rate is equal to the predetermined flow-through rate, wherein if the existing flow-through rate of the liquid flowing through the pump is determined to be less than the predetermined flow-through rate, the means for opening and closing the bypass valve opens the bypass valve to permit at least a portion of the liquid flowing through the pump to circulate from a discharge side of the pump to a suction side of the pump through the bypass flow line and if the existing flow-through rate of the liquid flowing through the pump is determined to be greater than or equal to the predetermined flow-through rate, the means for opening and closing the bypass valve closes the bypass valve.

17. An apparatus according to claim 16, wherein the means for opening and closing the bypass valve is operative to move the bypass valve to and between a closed state and an opened state, the opened state being one of a wide opened condition and a partially opened condition defined as being between the wide opened condition and the closed state.

18. A bypass control apparatus adapted for use with a pump pumping a liquid refrigerant therethrough, comprising:

a bypass flow line operative for circulating at least a portion of the liquid refrigerant flowing through the pump from a discharge side of the pump to a suction side of the pump;

a bypass valve interposed in the bypass flow line and operative to move to and between an opened state thereby permitting the at least portion of the liquid refrigerant flowing through the pump to continuously circulate through the bypass flow line back to the pump and a closed state thereby preventing the at least portion of the liquid refrigerant flowing through the pump from circulating through the bypass flow line;

a sensor for determining an existing flow-through rate of the liquid refrigerant flowing through the pump; and a controller in communication with the sensor and the bypass valve and operative to move the bypass valve to the closed state when the controller determines that the existing flow-through rate of the liquid refrigerant flowing through the pump is at least a predetermined flow-through rate and to move the bypass valve to the opened state when the controller determines that the existing flow-through rate of the liquid refrigerant flowing through the pump is less than the predetermined flow-through rate.

* * * * *